United States Patent [19]

Ham

[11] 4,334,682

[45] Jun. 15, 1982

[54] SIMULATED BALL SPORT AMUSEMENT INSTRUMENT

[76] Inventor: Young S. Ham, Dong II Apartment, Room No. 516, 234-84, Sung In 2-dong, Jongro-ku, Seoul, Rep. of Korea

[21] Appl. No.: 66,311

[22] Filed: Aug. 14, 1979

[51] Int. Cl.[3] ..... A63F 7/07; A63F 7/20

[52] U.S. Cl. ..... 273/85 E; 273/85 C

[58] Field of Search ..... 273/85

[56] References Cited

U.S. PATENT DOCUMENTS

| | | | |
|---|---|---|---|
| 1,310,482 | 7/1919 | Iles | 273/85 E |
| 1,713,247 | 5/1929 | Young | 273/85 E |
| 2,201,560 | 5/1940 | Nelson | 273/85 R |
| 3,172,664 | 3/1965 | Lohr et al. | 273/85 R X |
| 4,060,245 | 11/1977 | Duch | 273/85 R |

FOREIGN PATENT DOCUMENTS

| | | | |
|---|---|---|---|
| 925198 | 3/1947 | France | 273/85 D |
| 951911 | 4/1949 | France | 273/85 E |
| 1114892 | 12/1955 | France | 273/85 E |
| 509340 | 6/1955 | Italy | 273/85 E |
| 334354 | 1/1959 | Switzerland | 273/85 E |
| 4932 | of 1909 | United Kingdom | 273/85 E |
| 415260 | 8/1934 | United Kingdom | 273/85 C |
| 1193362 | 5/1970 | United Kingdom | 273/85 E |

*Primary Examiner*—Paul E. Shapiro

*Attorney, Agent, or Firm*—Fleit & Jacobson

[57] ABSTRACT

A simulated ball sport amusement instrument for optionally playing one of several different games. The instrument has a rectangular frame with vertical side and end walls. A plurality of hitting units are supported by the walls and have hitting surfaces disposed within the interior of the frame. Handle levers are connected to ends of the hitting units to control movement of the hitting surfaces. Holes are provided on the tops of the walls for receiving poles of football or basketball goals, or poles of a net for volleyball. In one embodiment, the interior of the frame is divided by a grille that has a plurality of openings in which the hitting surfaces of the hitting units are positioned. The dimensions of the grille openings are smaller than a ball used with the instrument so that the ball is prevented from falling through the playing surface and is always in a position to be hit by one of the hitting units.

6 Claims, 11 Drawing Figures

SIMULATED BALL SPORT AMUSEMENT INSTRUMENT

DETAILED EXPLANATION OF INVENTION

The present invention relates to a simulated ball sport amusement game. More particularly, the invention provides an amusement instrument or device for playing ball sport games, such as, basketball, football, and volleyball. The term "football" is being used to identify the game commonly known in the U.S. as "soccer".

BACKGROUND OF INVENTION

According to the prior art, it is known that a ball sports amusement instrument consists of a system to play simply only a specific sport game. Namely, in the football amusement instrument, a group of dolls forms the teams, and the dolls are positioned on control bars rotated by the manual operation of the players so that the ball in the court is moved by a collision with the dolls. In the basketball amusement instrument, a round goal is placed on each of the teams and, when the player pushes the lever key located on the outside of the court, with the ball placed on the shooting position, the ball is bounced upwardly and the ball enters into the goal. The aim of this invention is to present a synthetic ball sport amusement instrument that can amuse the synthetic ball sports, such as football, basketball, and volleyball.

DEFECTS IN THE PRIOR ARTS

As mentioned above, according to the prior art, it is common that an instrument is limited to a single ball sport game, whether it is football or basketball and, unless the ball is moved fortunately on a position of a team, it is unable to attack the opposite team because it is impossible to draw out optionally the ball from the opposite team. Accordingly, it is unable to attack positively the opposite team; and the sole purpose of a player is to protect his team from the attack of the opposite team. Especially, because the elasticity of a spring in the lever gives only a certain constant force, it is difficult to make a long pass or a short pass of the ball so that the players cannot display a specific technique to control the ball and the ball sometimes rebounds to the outside of the court.

CHARACTERISTIC FEATURE OF THIS INVENTION

According to the present invention, it is possible to optionally play the ball sport games, such as football, basketball or volleyball from this single instrument of the present invention. Especially, according to the present invention, the players can make a lot of various attacks on the opposite team and, because there is no need to wait for the ball, as the case in the prior art, the players should rather take the ball by force and also control the ball by skill and specific technique that is superior to that of the player of the opposite team so that the game is more active and gives the players thrill and interesting. The players can attain a long pass or a short pass of the ball in the game and the ball does not make a big rebounding in the game. The players can drive the ball along on the surface of the court or fly the ball in the air so that the players can enjoy the game as if an actual play is exercised. So, the players or the observers of the game can enjoy fully the pleasure and amusement.

Furthermore, because the construction of the instrument of present invention is simple and durable and the machine is one having little trouble in mechanics, children or adults, male or female, together can enjoy this instrument.

CONSTRUCTION OF THIS INVENTION

Figure 1:
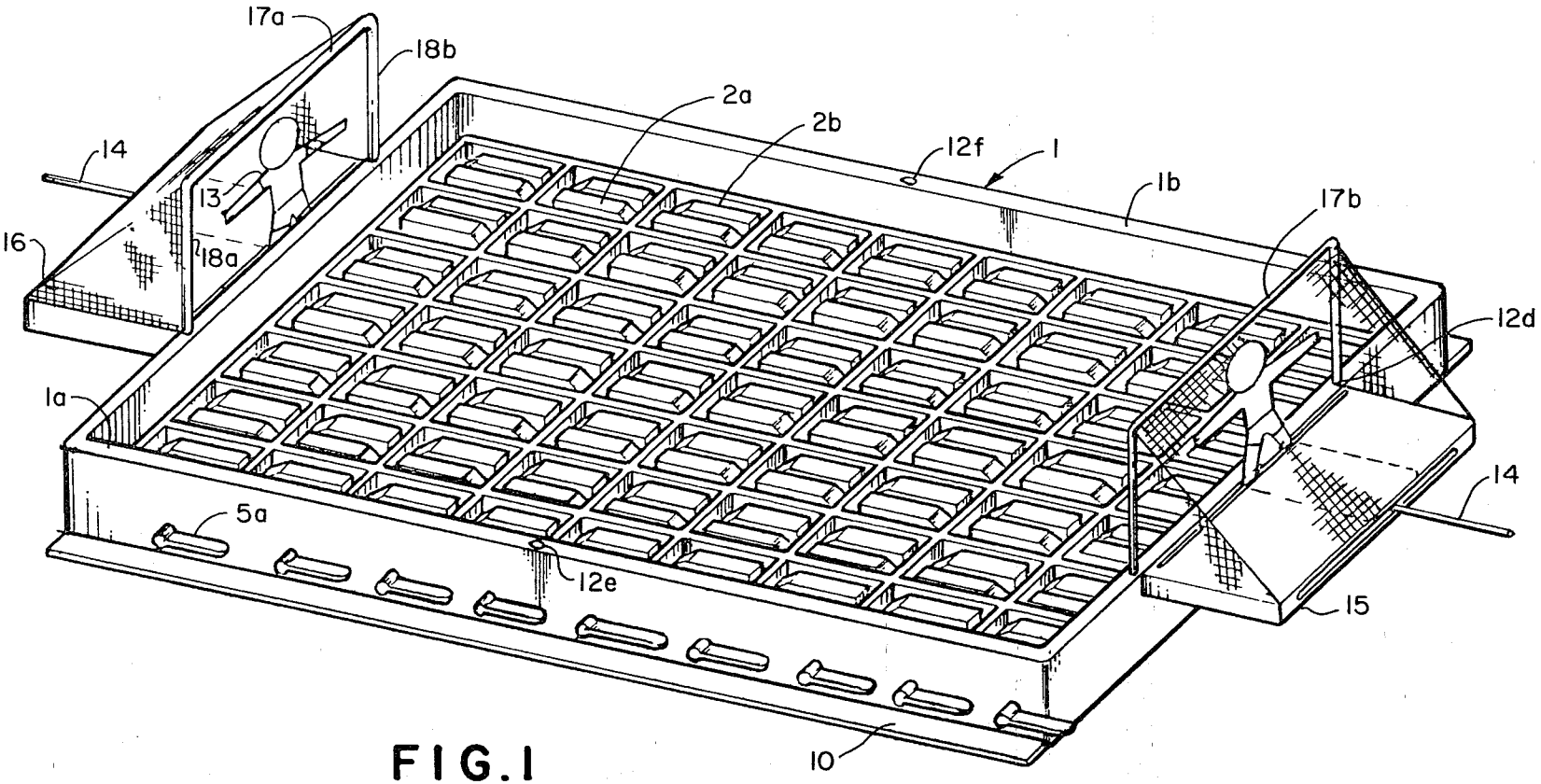
FIG. 1 is a perspective of one embodiment of an instrument according to the present invention.
Figure 2:
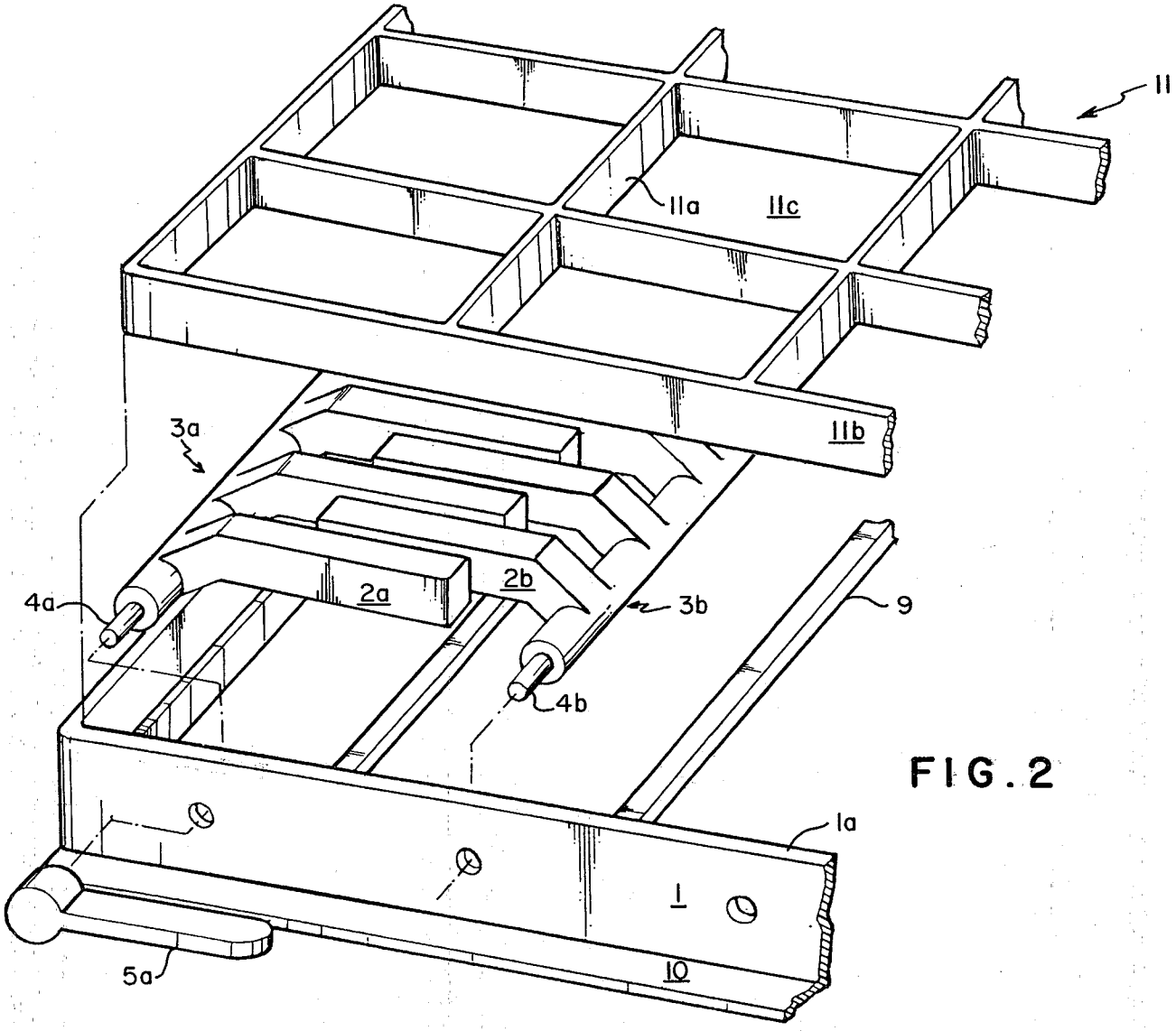
FIG. 2 is an exploded perspective of a portion of the instrument of FIG. 1.
Figure 3:
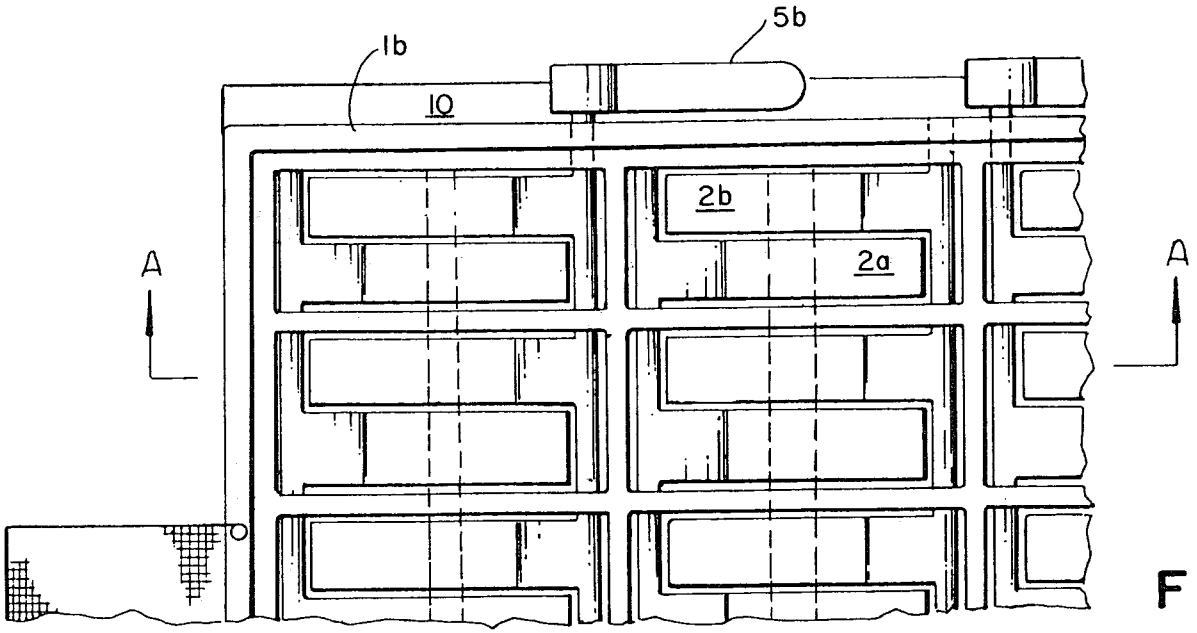
FIG. 3 is a top plan view, enlarged, of a portion of the instrument of FIG. 1.
Figure 4:
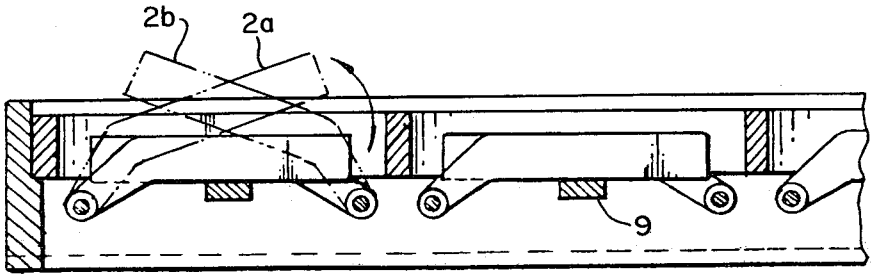
FIG. 4 is a cross-sectional view along line A—A in FIG. 3.
Figure 5:
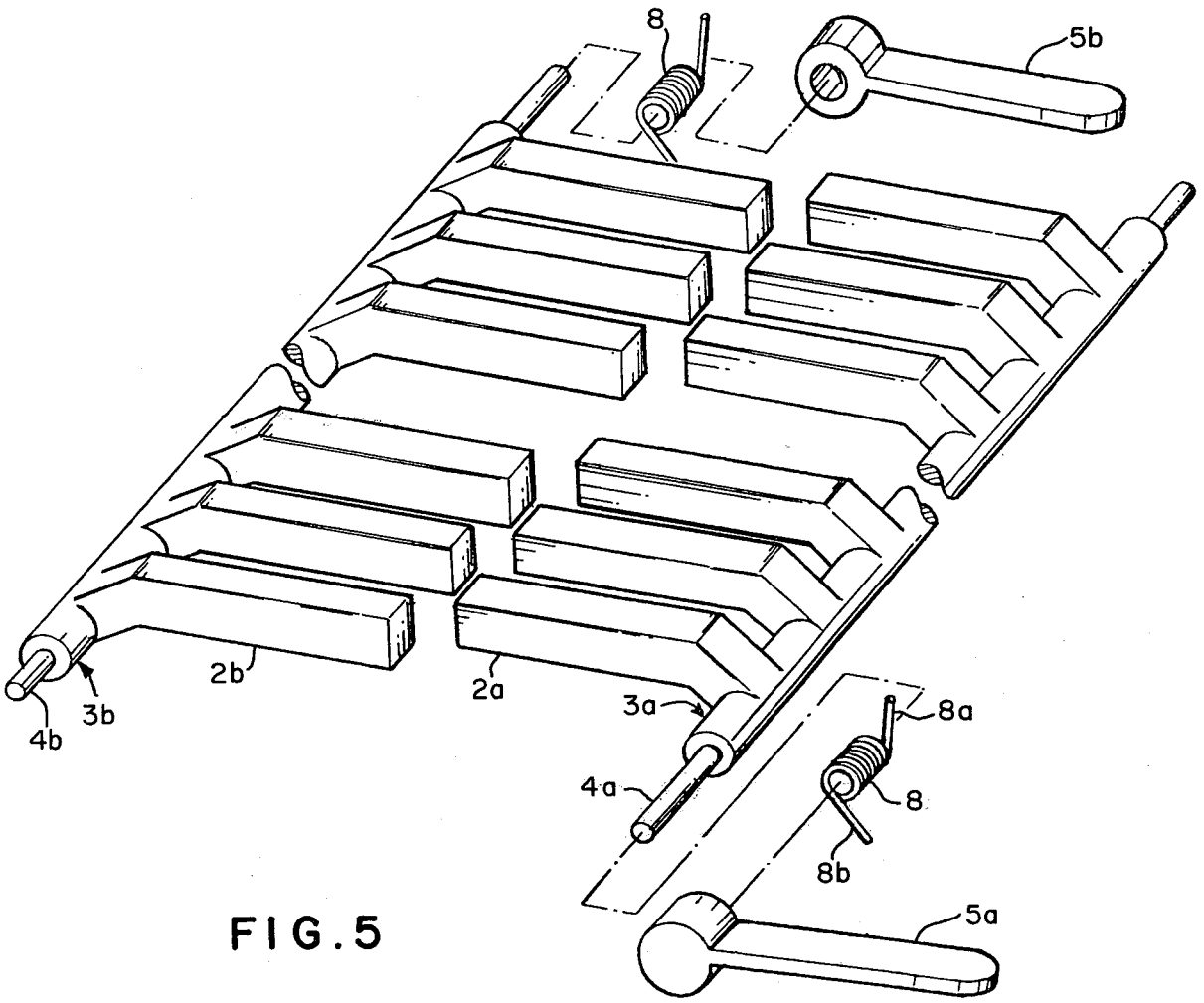
FIG. 5 is an enlarged, exploded perspective of a shaking member of the instrument of FIG. 1.
Figure 6:
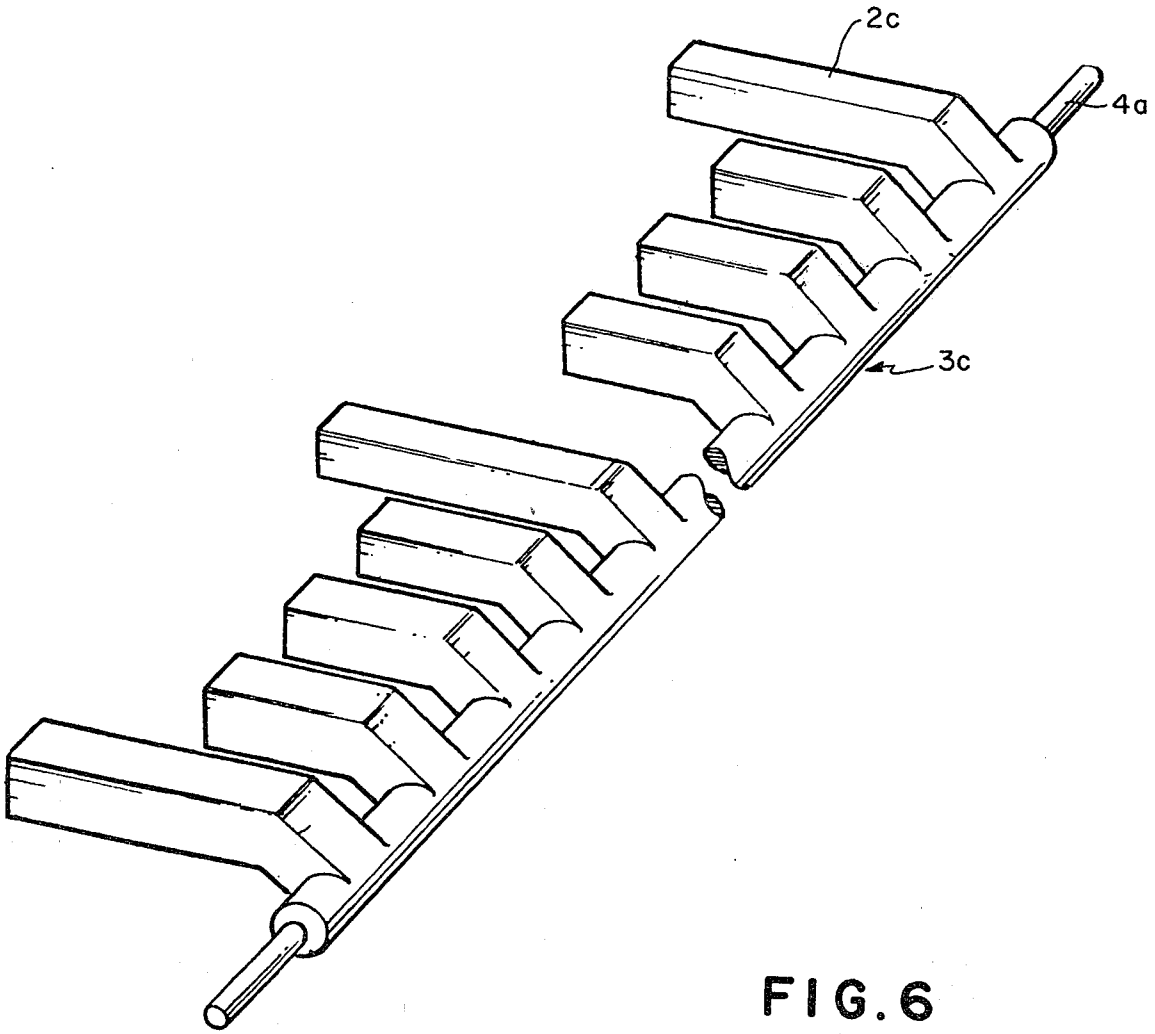
FIG. 6 is a perspective of another embodiment of a shaking member.
Figure 7:
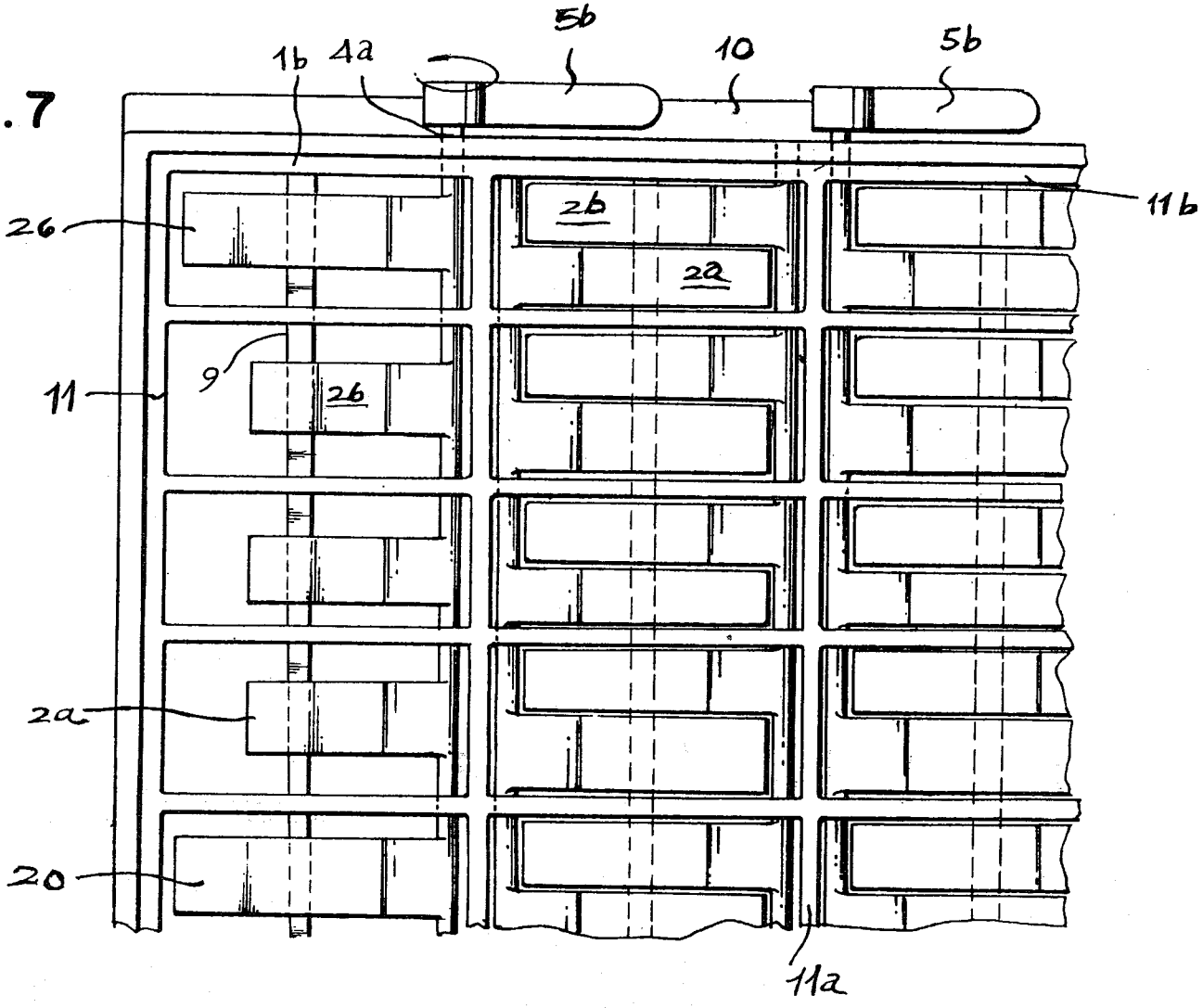
FIG. 7 is a partial top plan view illustrating use of the shaking member of FIG. 6.
Figure 8:
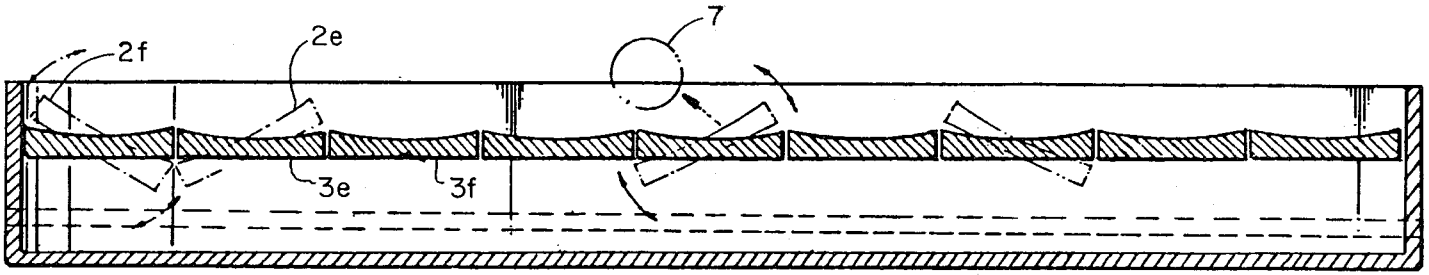
FIG. 8 is a cross-sectional view illustrating an embodiment of the invention using a plate-type shaking board.
Figure 9:
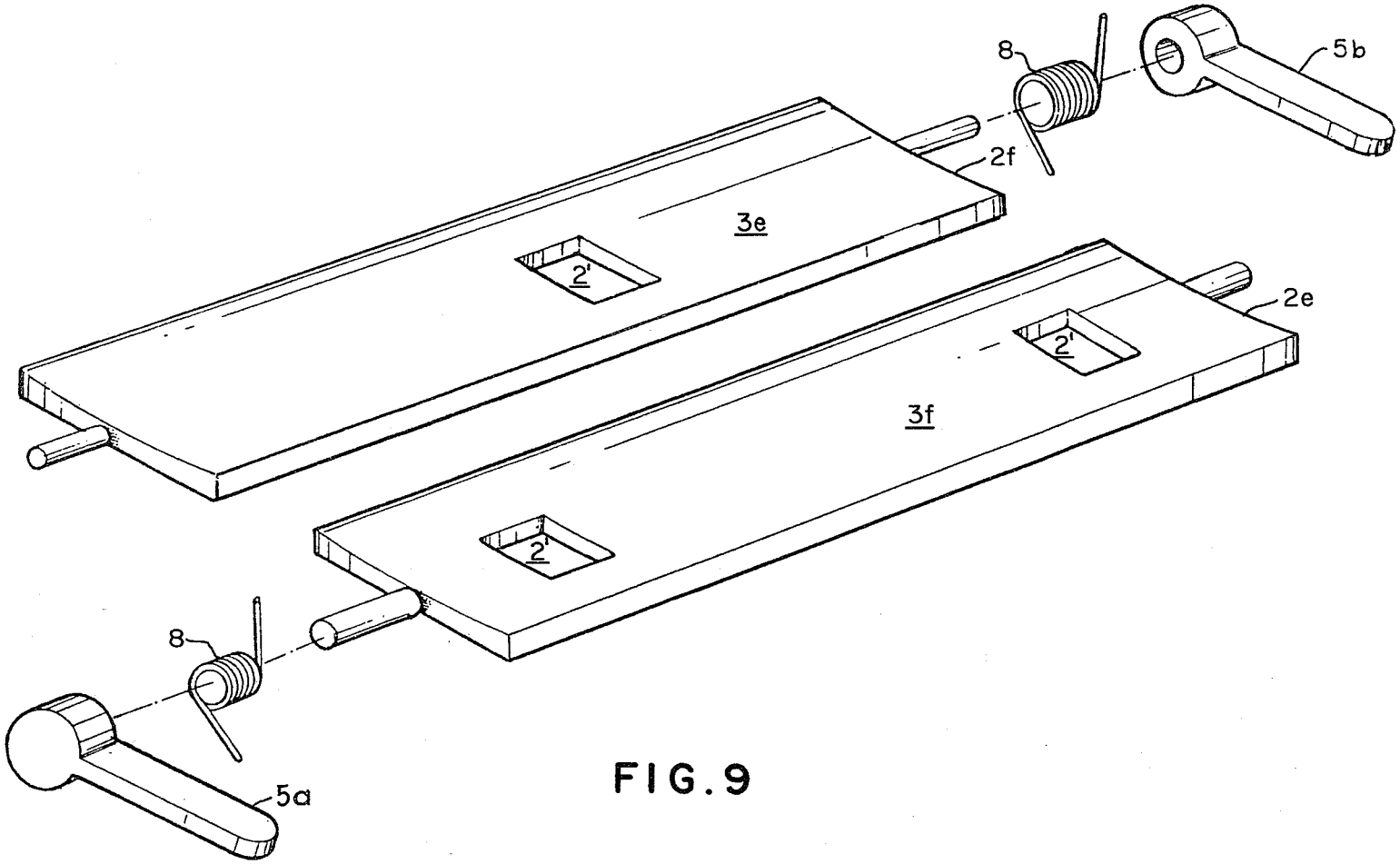
FIG. 9 is an exploded perspective view of the plate-type shaking board of FIG. 8.
Figure 10:
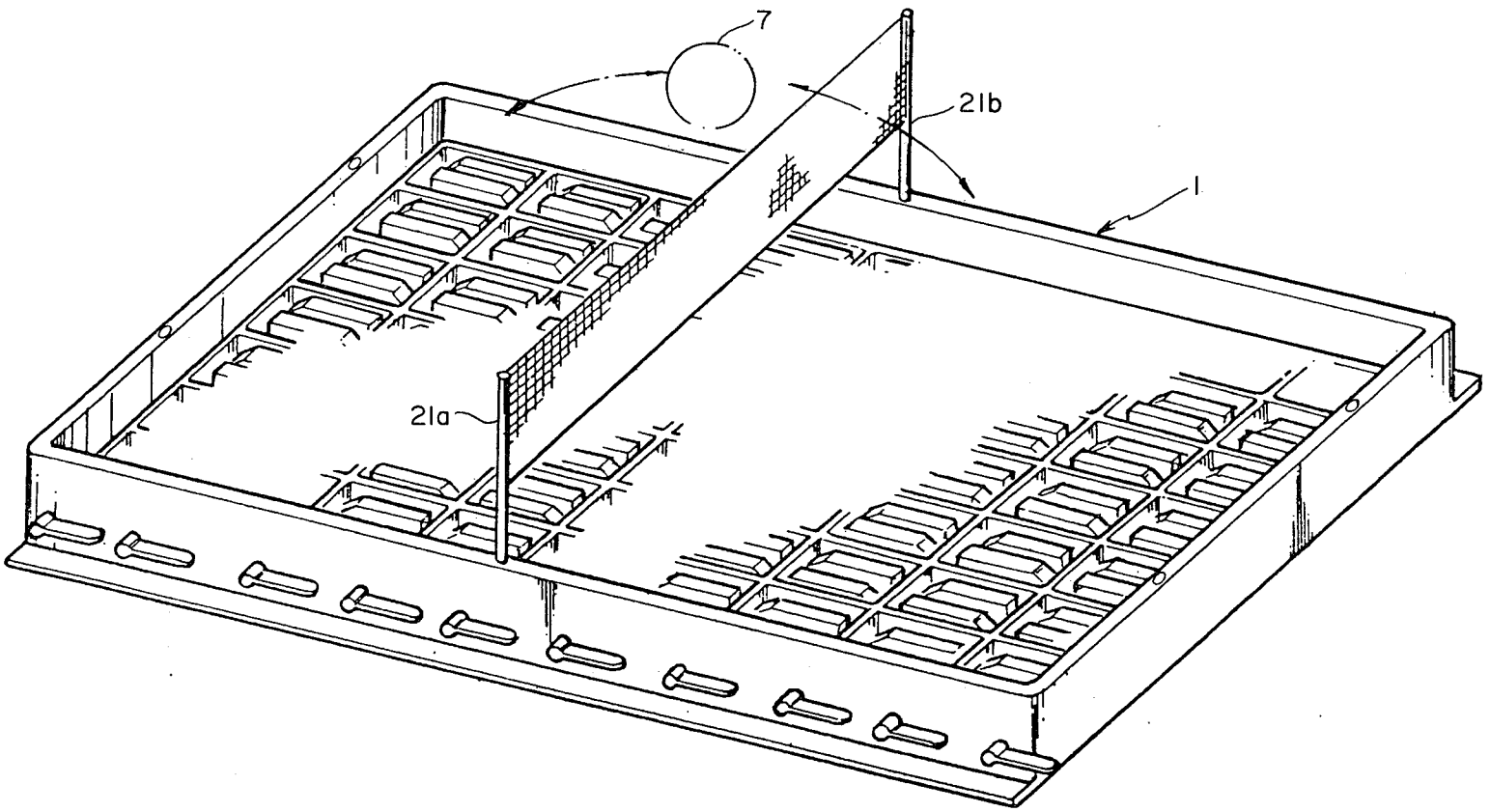
FIG. 10 is a perspective view of the game court provided by the present invention, as used in volley ball.
Figure 11:
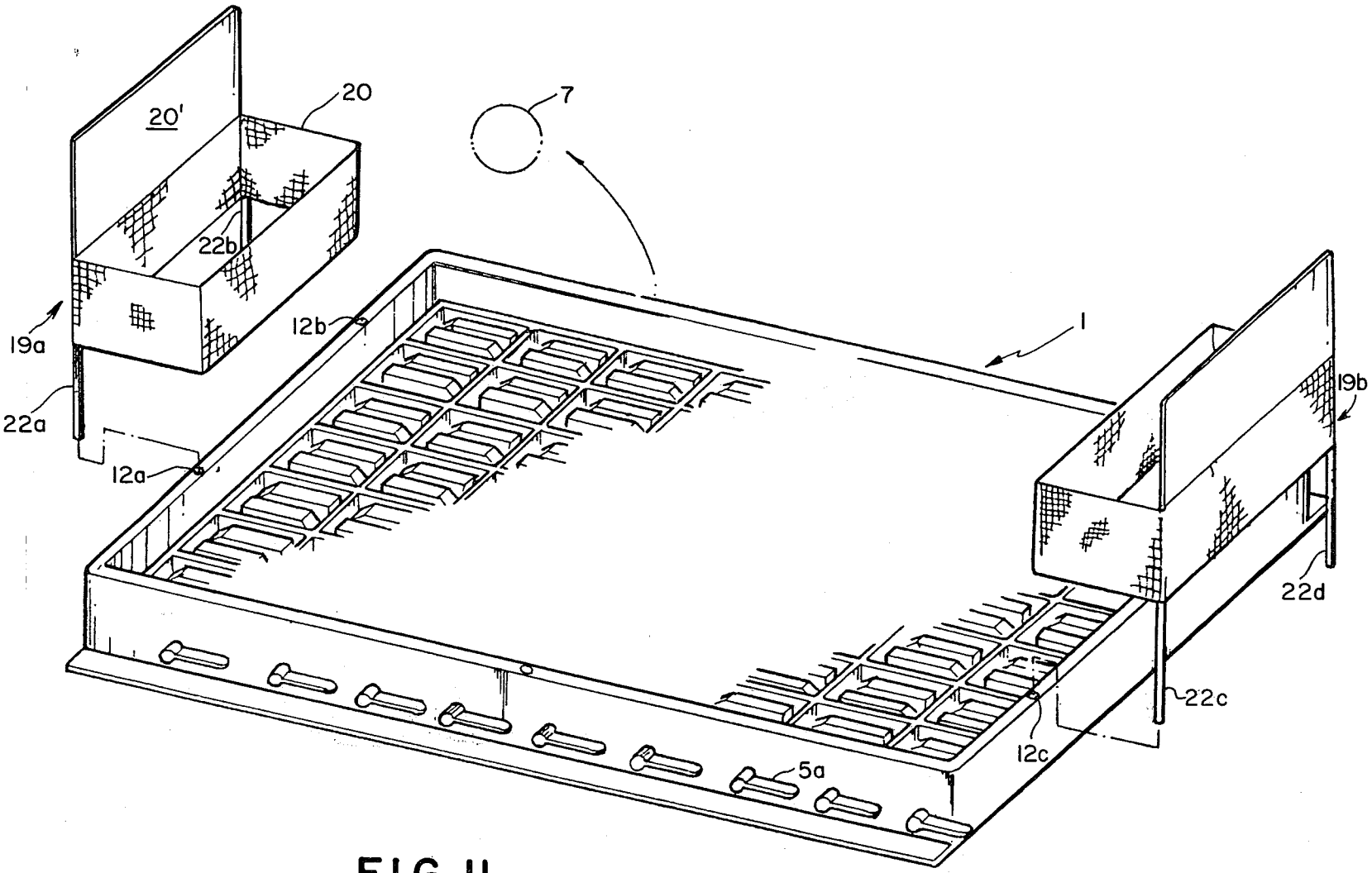
FIG. 11 is a perspective view of the game court provided by the present invention, as used in basketball.

The instrument of present invention is illustrated in detail, in accordance with the accompanying drawings, as follows:

On the bottom of the rectangle court frame (1) of the instrument, there are a series of hitting units in which a pair of hinge bars (4*a* and 4*b*), having a group of hitting members (2*a* and 2*b*) in a shape of the teeth of a comb, is located, each other alternately. The hitting members are linked with the hinge bar by the shaking members (3*a* and 3*b*).

On the outside of the both side lines (1*a* and 1*b*) of the court frame (1), the one end of the hinge bar (4*a* and 4*b*) is extruded and also connected with the handle lever (5*a* and 5*b*). Because the handle lever (5*a* and 5*b*) is fixed to the hinge bar (4*a* and 4*b*) by a pin, when a player pushes the handle lever (5*a* and 5*b*) downwardly, the shaking member (3*a* and 3*b*) moves and the hitting member (2*a* and 2*b*) rises to hit the ball (7) so that the ball (7) moves to another location. Because the hinge bar (4*a* and 4*b*) has the torsion spring (8) one end (8*a*) of which is connected to the shaking member (3*a* and 3*b*) and the other end (8*b*) to the side of the frame (1), when the player releases the pushing of the handle lever (5*a* or 5*b*), the handle lever returns to the original position and the shaking member (3*a* and 3*b*) also to the original position.

In order to support the horizontal level of the hitting members (2*a* and 2*b*), there is a supporting plate (9) connected between the frame (1*a*) and the frame (1*b*) and on which the hitting members (2*a* and 2*b*) are placed.

In order to control the rotation of the handle lever (5*a* and 5*b*), a stopping line (10) is attached on the both outer sides of the frame (1*a* and 1*b*) so that the handle lever cannot rotate over the stopping line (10).

In order to prevent the ball (7) from jamming into the space between the hitting members, there is the grille (11) consisting of the horizontal portion (11*a*) and the vertical portion (11*b*) and which is fixed to the frame (1). Through the spaces formed by the horizontal portion and the vertical portion of the grille, each of the hitting members (2*a* and 2*b*) is driven and operated.

On the central part of the edge of the frame (1), there are two holes (12*a* and 12*b*) (12*c* and 12*d*); and, on the central part of the side lines of the frame (1), the holes (12*e* and 12*f*). When a football game is played, a pair of the poles (18*a* and 18*b*) of the goal posts or gates (17*a* and 17*b*) having the net (16) are fixed in the holes (12*a* and 12*b*) and (12*c* and 12*d*) and in which a doll (13) representative of the goalkeeper is movable by the handle (14) positioned on the base (15).

When basketball is played, the pole (22*a* and 22*b*) and (22*c* and 22*d*) of the goal board (19*a* and 19*b*) are fixed on the holes (12*a* and 12*b*) and (12*c* and 12*d*), respectively; and the ball (7) is shot into the net (20) having the reaction board (20') of the goal board (19*a* and 19*b*).

When volleyball is played, the poles (21*a* and 21*b*) of the net (21) are fixed in the holes (12*e* and 12*f*) and one of the teams should pass the ball over the net to the opposite court within three times of hitting the ball (7).

According to the instrument of present invention, the length of the hitting member (2*c*) of the shaking member (3*c*) in the units located on the both last units may be long, as compared with the ones in the another units, so that, in volleyball, the ball (7) is sent to a long distance in the opposite court by a serve.

Meanwhile, according to another embodiment, the shaking members (3*a* and 3*b*) having the hitting members (2*a* and 2*b*) can be replaced with the shaking boards (3*e* and 3*f*) having curved portions (2*e* and 2*f*). In this case, the shaking boards (3*e* and 3*f*) have a concaved position (2') on each of the positions of a football team so that, when the ball is bounded out of the court, the ball is put on a position near the place where the ball is bounded out and, by hitting the ball as a free kick, the game is continued.

The installation of the shaking member (3*e* and 3*f*) having the curved hitting portion (2*e* and 2*f*) is same as the case of the shaking member (3*a* and 3*b*) having the hitting member (2*a* and 2*b*). However, when the shaking members (3*e* and 3*f*) are equipped into the frame (1), there is no need to install the grille (11).

ACTION AND EFFECT OF THIS INVENTION

The ball (7) having a size that does not fall into the gap (11*c*) of the grille (11) is placed on the surface of the grille (11); and the goal gates (17*a* and 17*b*) or the goal boards (19*a* and 19*b*) are positioned in the holes (12*a* and 12*b*) or (12*c* and 12*d*). By rotating a series of the handle levers (5*a* and 5*b*) located on the both outsides (1*a* and 1*b*) of the frame (1) within the scope of 90 degree; the ball (7) is hit to the opposite court or, by making the hitting members to rise in a right angle, it is possible to stop or prevent the forward passing of the ball (7) of the opposite party. By forward passing and entering the ball (7) into the goal gate of the opposite team, a goal or score is obtained and the team who obtains the most scores wins the game.

When the ball (7) is located on the central part of the hitting members (2*a* and 2*b*), both team can optionally drive the ball (7) by operating swiftly the handle levers (5*a* and 5*b*) and the both parties can take positively operation and action to fight against the opposite team. When the edge of the hitting members (2*a* and 2*b*) hits the ball (7), the ball flies to a distant place and, when the middle part of the hitting member hits the ball, the ball goes a short distance, while, when the end part of the hitting member hits the ball, the ball moves on even shorter distance. So, by the position of the hitting member to hit the ball (7), the attack is obtained variously. When the ball (7) goes outside of the court, the ball is placed on the hitting member of the opposite team and, where the ball is out, the opposite team is allowed to hit the ball (7).

When volleyball is played, the ball (7) is placed on the long hitting member (2*c*) in the last unit and the serve is made. It is important that a team should use the handle levers located on his court only and the handle levers located on the opposite team cannot be used; and the ball (7) in the court must be passed over the net to the opposite court by operating three times the handle levers. So, such operation is continued and repeated until a team has failed the exercise.

When basketball is played, because the goal board (19*a* and 19*b*) is formed in a quadrangle and placed in a high place, in order to score the ball, the ball should be hit to fly highly. So, it is important that the handle levers must be pushed strongly when the ball (7) is placed on the end part of the hitting members (2*a* and 2*b*).

When the handle lever is pushed downwardly, the hitting members (2*a* and 2*b*), as well as the shaking members (3*a* and 3*b*), are risen upwardly so that, when the handle lever is pushed downwardly, the ball on the hitting member is hit essentially. So, because the ball is hit competitively by the early operation of the handle lever made by the both players, the game gives the players much interesting and good attacking sense.

Especially, the grille (11) controls the rebounding of the ball (7) and, although the both players are operating competitively the handle levers so that the shaking members (3*a* and 3*b*) are opened each other, there is no fear that the ball (7) may hang on the grille (11) or drop under the grille (11).

Further benefits of the present invention are that, because several sports games can be played with this single instrument, the players can have much interest in the several ball sport games and can enjoy economically several ball sports game by reducing expenses to buy another means or equipments.

Because the instrument of present invention is simple and hard in construction and there is little likelihood to bring a disorder or trouble in the operation and the movement of the ball may be operated variously by controlling the speed or stress of the handle levers, the players can develop optionally a lot of the techniques or the skills to operate the ball and, by a personal operation, the game can bring much interest.

It is profitable that the game can be continued by the participation of more than two persons and everybody of the children or the adults, in the male or female, can operate the instrument and play the game without requiring any specific skill or technique. And, if a person studies a specific skill or technique to operate the instrument, he can develop a lot of the various attacks and have much interest and amusement from this instrument.

I claim:

1. A ball sport amusement instrument for optionally playing one of several different games comprising:

a rectangular frame having vertical side walls interconnecting vertical end walls; each of said side walls having a longitudinally-extending series of openings formed therein, the openings in one of the series being in alignment with the openings in the other of the series to form pairs of aligned openings;

a plurality of hitting units, each unit having a hitting surface disposed in the interior of said frame and hinge bars formed at outer ends thereof extending through respective pairs of said openings;

handle levers connected to said outer ends of said hinge bars, the hitting surfaces being movable from rest positions into hitting positions by rotation of the handle levers, said hitting surfaces defining a playing surface extending between said side and said end walls such that a ball lying anywhere on the playing surface can be hit by at least one hitting surface;

means carried by said end walls for receiving poles of goal gates for football and basketball;

means carried by said side walls for receiving poles of a net for volleyball;

a grille disposed in the interior of said frame and having an upper horizontal surface substantially planer with the rest positions of the hitting surfaces, the grille defining a plurality of openings in which the hitting surfaces are positioned; and said hitting units having a plurality of separate hitting surfaces spaced from each other in the shape of teeth of a comb, the hitting surfaces of adjacent pairs of hitting units being interleaved with each other so that a ball can be simultaneously hit by a hitting surface of each of the adjacent pairs of hitting units.

2. An instrument according to claim 1, wherein the hitting surfaces of hitting units closest to said end walls have different lengths, with one of the hitting surfaces having an increased length for making a serve when playing volleyball.

3. An instrument according to claim 1, further comprising:

supporting plates positioned below said hitting surfaces for holding said hitting surfaces of said hitting units substantially horizontal when in their rest positions;

stopping boards on said side walls for limiting rotation of said handle levers to prevent movement of said hitting surfaces below said supporting plates; and biassing means for urging said hitting units towards their rest positions.

4. An instrument according to claim 1, further comprising a net assembly for use with football, the net assembly having poles received in said means carried by said end walls, a net and a base supported by said poles, a doll representative of a goal keeper, and a lever supported by said base for controlling movement of the doll.

5. An instrument according to claim 1, wherein at least one hitting surface has a recess formed therein for receiving a ball when the hitting unit is in a rest position.

6. A ball sport amusement instrument for optionally playing one of several different games comprising:

a rectangular frame having vertical side walls interconnecting vertical end walls, each of said side walls having a longitudinally-extending series of openings formed therein, the openings in one of the series being in alignment with the openings in the other of the series to form pairs of aligned openings;

a plurality of hitting units, each unit having a hitting surface disposed in the interior of said frame and hinge bars formed at outer ends thereof extending through respective pairs of said openings, the hitting surfaces of the hitting units being curved surfaces extending substantially the entire distance between the side walls, adjacent hitting surfaces being closely spaced from each other to prevent passage of a ball therebetween;

handle levers connected to said outer ends of said hinge bars, the hitting surfaces being movable from rest positions into hitting positions by rotation of the handle levers, said hitting surfaces defining a playing surface extending between said side and said end walls such that a ball lying anywhere on the playing surface can be hit by at least one hitting surface;

means carried by said end walls for receiving poles of goal gates for football and basketball;

means carried by said side walls for receiving poles of a net for volleyball; and a net assembly for use with football, the net assembly having poles received in said means carried by said end walls, a net and a base supported by said poles, a doll representative of a goal keeper, and a lever supported by said base for controlling movement of the doll.

* * * * *